US005167324A

United States Patent [19]

Miller

[11] Patent Number: 5,167,324

[45] Date of Patent: Dec. 1, 1992

[54] SHIPPING CARTON AND DISPLAY UNIT FOR TUBES

[75] Inventor: Christopher J. Miller, Clifton Park, N.Y.

[73] Assignee: General Electric Company, Waterford, N.Y.

[21] Appl. No.: 676,600

[22] Filed: Mar. 28, 1991

[51] Int. Cl.[5] ..... B65D 75/58

[52] U.S. Cl. ..... 206/44.12; 206/44.11; 206/45; 229/235; 229/242; 229/120.18

[58] Field of Search ..... 206/44.11, 45, 45.12, 206/192; 229/235, 242, 120.18

[56] References Cited

U.S. PATENT DOCUMENTS

| | | | |
|---|---|---|---|
| 1,770,701 | 7/1930 | Kelly | 229/120.18 |
| 2,995,238 | 8/1961 | Casselman | 206/44.11 X |
| 3,044,211 | 7/1962 | Palm | 229/120.18 X |
| 3,115,290 | 12/1963 | Byassee | 229/120.18 X |
| 3,167,240 | 1/1965 | Collura et al. | 229/51 |
| 3,326,444 | 6/1967 | Farquhar et al. | 229/120.18 |
| 3,653,579 | 4/1972 | Stranicky | 229/37 R |
| 3,669,251 | 6/1972 | Phillips, Jr. | 206/44 R |
| 3,884,348 | 5/1975 | Ross | 206/45.12 |
| 4,070,489 | 1/1978 | Pahnke | 206/45.12 X |
| 4,113,100 | 9/1978 | Soja et al. | 206/602 |
| 4,553,666 | 11/1985 | Gullikson | 229/235 X |
| 4,640,417 | 2/1987 | Durand | 206/426 |

*Primary Examiner*—Paul T. Sewell
*Assistant Examiner*—Ted Kavanaugh

[57] ABSTRACT

A shipping carton where at least one divider is convertible without the use of tools to an attractive display case. The dividers in the carton reinforce the carton when used for shipping and hold the contents in substantially vertical alignment for display. The conversion without tools is facilitated by a tear strip which separates the upper and lower portions in all but one side. Scores separate the upper and lower portions of the one side and the divider. The scores and the tear strip in place connect the upper and lower portions to provide a strong shipping carton, but upon removal of the tear strip, the scores are readily broken without tools to remove the upper portion and allow the lower portion to be used as an attractive display case.

6 Claims, 4 Drawing Sheets

SHIPPING CARTON AND DISPLAY UNIT FOR TUBES

FIELD OF THE INVENTION

This invention relates generally to paperboard and corrugated shipping cartons. More particularly to a shipping carton with dividers which may be converted without the need for tools to an attractive display unit by use of an integral tear strip and scores.

BACKGROUND OF THE INVENTION

Although shipping cartons convertible to display units, shipping cartons prepared from a single paperboard blank and shipping cartons containing dividers are known, none heretofore provide the unique combination of features of the present invention.

U.S. Pat. No. 3,167,240 to Collura et al. relates to a reducible size carton formed of a single blank which holds a standard quantity of frozen food products which is readily converted to a carton which holds half a standard quantity of such products.

U.S. Pat. No. 3,653,579 to Stranicky relates to a folding carton especially suited for frozen products which is produced from a paperboard strip with a minimum of waste.

U.S. Pat. No. 3,669,251 to Phillips relates to a display carton which provides lateral support for displayed items to maintain display stability after some of the displayed articles have been removed from the carton.

U.S. Pat. No. 3,884,348 to Ross relates to a combination cardboard shipping and display carton with a tear strip to facilitate the conversion having oversized side flaps folded into the clearance between rows of products in the carton to minimize any tendency of the carton to burst during shipping or handling.

U.S. Pat. No. 4,113,100 to Soja et al. relates to a display carton with a tear strip completely around the carton at a diagonal across the face panels and perpendicular across the side flaps.

U.S. Pat. No. 4,640,417 to Durand relates to a display packing carton divided into sections without top or bottom with locking lugs to hold the assembly opened out.

In contrast to the foregoing, the shipping carton of the present invention, through its unique placement of tear strips, scores and openings, may be constructed from a single paperboard blank and converted without the need for tools of any kind to an attractive display unit with dividers which hold the contents in neat vertical order.

SUMMARY OF THE INVENTION

The present invention provides a shipping carton with at least one divider which is convertible without tools to an attractive display case wherein the divider coating with the exterior of the carton maintains the contents free from damage during shipment and in substantial vertical alignment during display. The conversion from shipping carton to display case is effectuated without tools through a combination of a tear strip, a score in a wall of the carton parallel with a divider, a score in a divider and openings in the divider.

DESCRIPTION OF THE PREFERRED EMBODIMENT

Figure 1:
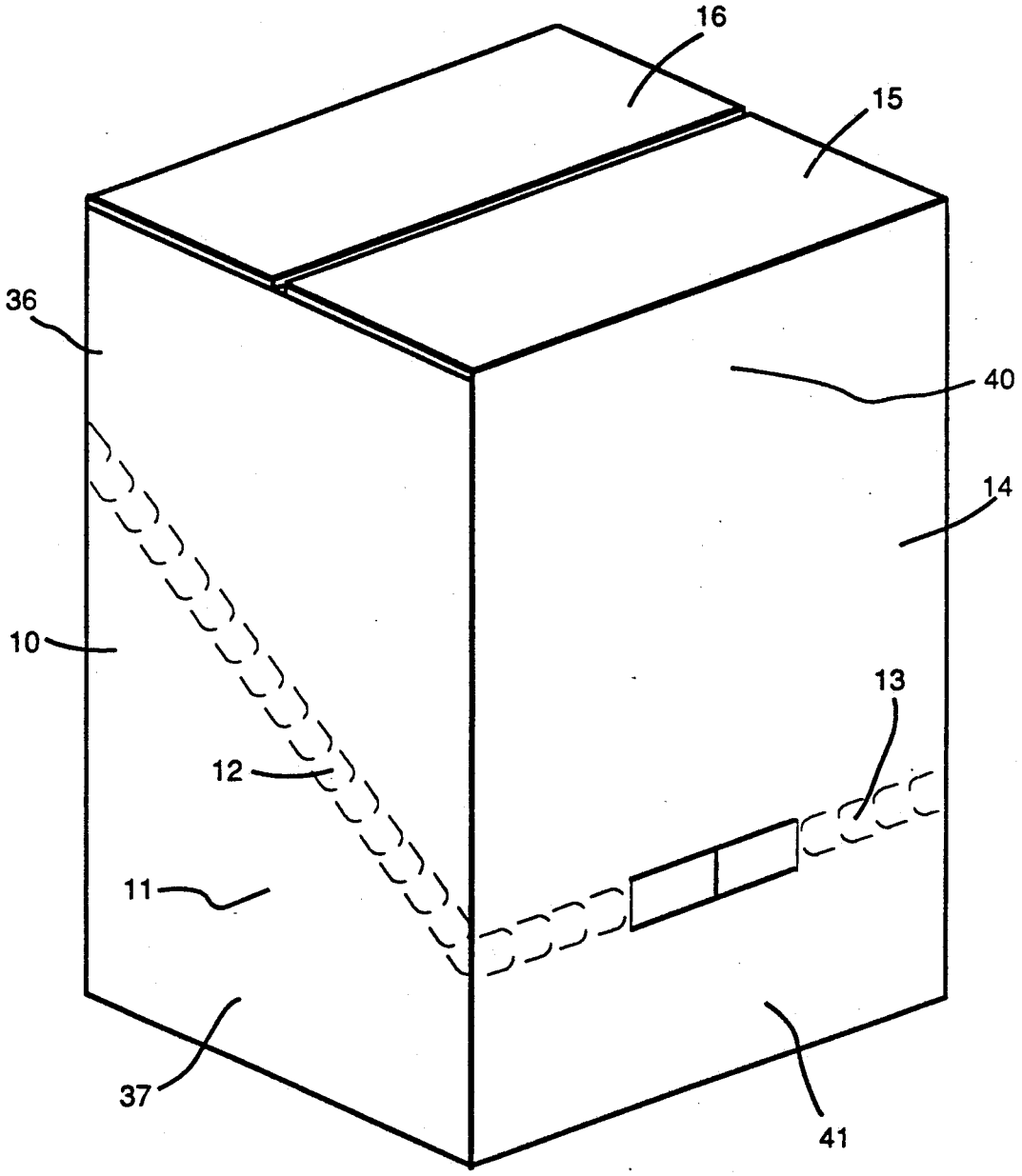
FIG. 1 is a schematic perspective of a shipping carton of this invention.

FIG. 1 shows in a perspective and schematic view an embodiment of a shipping carton 10 of this invention. The carton 10 has an upper portion 14, a lower portion 11 and tear strip portions 12 and 13 and has a front flap 15 and a rear flap 16 which after the carton 10 is filled with its contents are secured to the upper portion 14 of the carton 10 by tape or other means or to upper portion side flaps 30, not shown in FIG. 1 but illustrated in FIG. 4, by glue, staples or other means. The front panel 40 of the upper portion 14 of the carton 10 has a larger vertical dimension than the front panel 41 of the lower portion. The upper portion 14 is separated from the lower portion 11 by a tear strip in two portions 12 and 13 except in the rear panel of the carton. Tear strip portion 12 abuts tear strip portion 13 in substantially the center of the front panel and extends between the front panel 40 of the upper portion 14 of the carton 10 and the front panel 41 of the lower portion 11 of the carton 10 substantially horizontally and then diagonally upward between side panel 36 of upper portion 14 of the carton 10 and side panel 37 of lower portion 11 of carton 10. Tear strip portion 13 similarly extends substantially horizontally between the front panel 40 of upper portion 14 of the carton 10 and the front panel 41 of lower portion 11 of carton 10 and, not shown in FIG. 1 but shown in FIG. 4, then diagonally upward between side panel 33 of upper portion 14 of carton 10 and side panel 34 of lower portion 11 of carton 10. For other embodiments of this invention, a unitary tear strip may be employed or a tear strip of more than two portions may be used. Further, the exact location of the tear strip is not critical so long as front panel 40 is larger than rear panel 38, not shown in FIG. 1 but shown in FIG. 2, of upper portion 14 and the tear strip, scores and openings coact to permit easy removal of upper portion 14 from lower portion 13.

Figure 2:
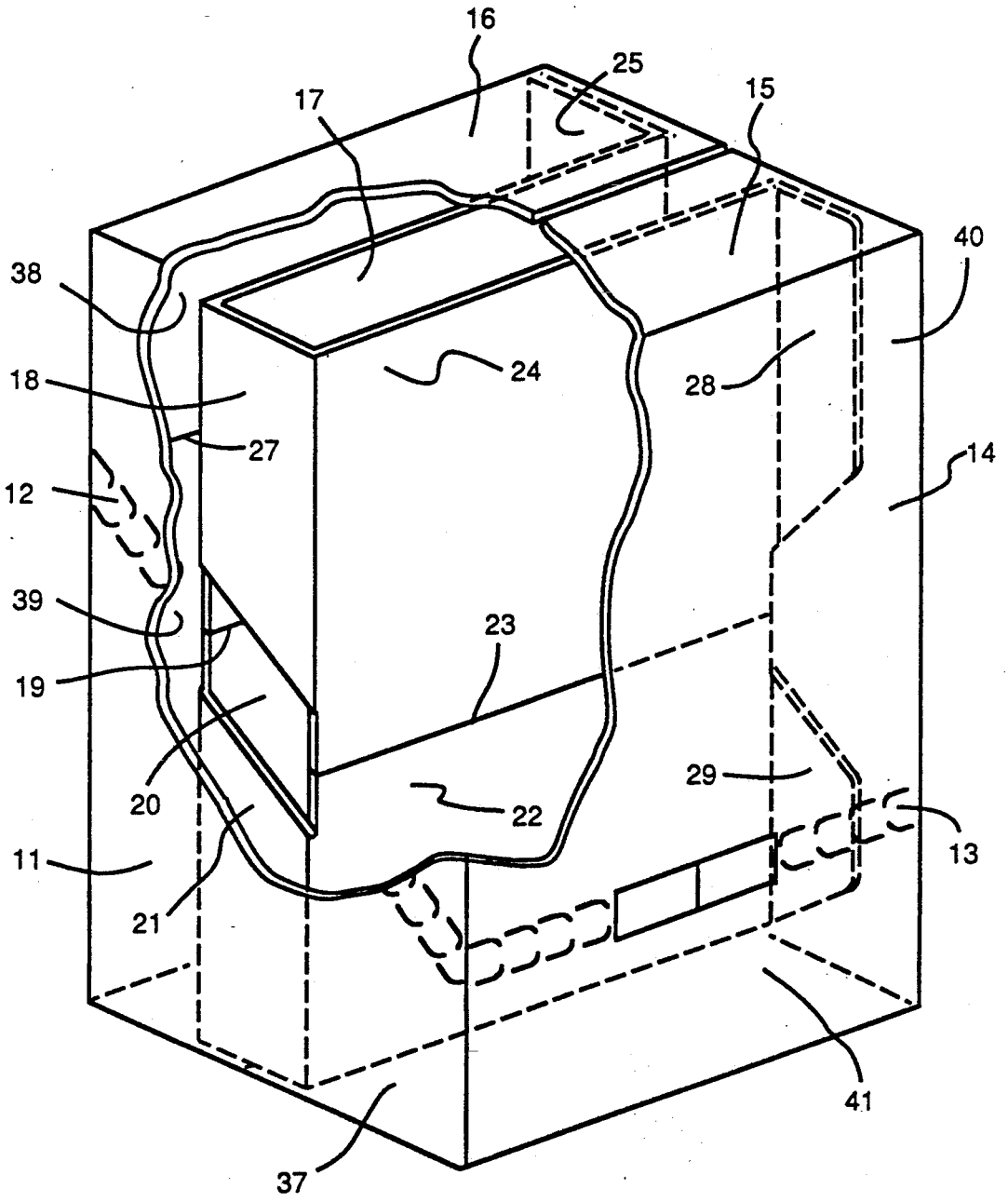
FIG. 2 is a cutaway perspective of a shipping carton of this invention providing a phantom view of dividers and tabs within the carton.

FIG. 2 in the cutaway portion shows the score 27 extending between rear panel 38 of upper portion 14 and rear panel 39 of lower portion 11. Also shown in FIG. 2 are the scores in the dividers in this embodiment, namely the score 23 between the upper portion 24 and the lower portion 22 of the divider closer to the front of the carton and score 19 between the upper portion 17 and lower portion 20 of the divider closer to the rear of the carton. Connecting tab 18 of the upper portion 14 of the carton 10 and connecting tab 21 of the lower portion 11 are sized, shaped and positioned so as to provide an opening so that when tabs 18 and 21 are affixed to the interior of side panel portion 36 of the upper portion 14 and the interior of side panel portion 37 of the lower portion 11, tear strip portion 12 may be freely removed without any difficulty since there is no contact between the tear strip portion 12 and the dividers. Similarly when end tabs, i.e. end tab 28 in the upper portion 14 and end tab 29 in the lower portion 11 are affixed, respectively, to the interior of the side panel 33, not shown in FIG. 2 but shown in FIG. 4, of the upper portion 14 and to the interior of the side panel 34, not shown in FIG. 2 but shown in FIG. 4, of the lower portion 11, there is an opening between the end tabs such that there is no contact between the portion 24 of the divider in the upper portion 14 or the portion 22 of the divider in the lower portion 11, with tear strip portion 13. Likewise, when rear connector tabs, i.e. rear connector tab 25 in upper portion 14 and rear connector tab 26, not shown in FIG. 2 but shown in FIG. 4, in lower portion 11 are affixed, respectively, to the interior of the side panel 33, not shown in FIG. 2 but shown in FIG. 4, of upper portion 14 and to the interior surface of side panel 34, not shown in FIG. 2 but shown in FIG. 4, of lower portion 11, there is an opening between the rear connector tabs such that there is no contact between the portion 17 of the divider in the upper portion 14 or the portion 20 of the divider in the lower portion 11 with the tear strip portion 13. It is readily recognizable that greater or fewer dividers can be used in embodiments of this invention so long as the dividers have openings which prevent contact between the tear strip and the divider, the dividers contain scores to permit easy removal of the upper portion 14 from lower portion 11 without the use of tools and tabs to be affixed to upper and lower portions of the side panels for strength of the carton when used for shipping.

Figure 3:
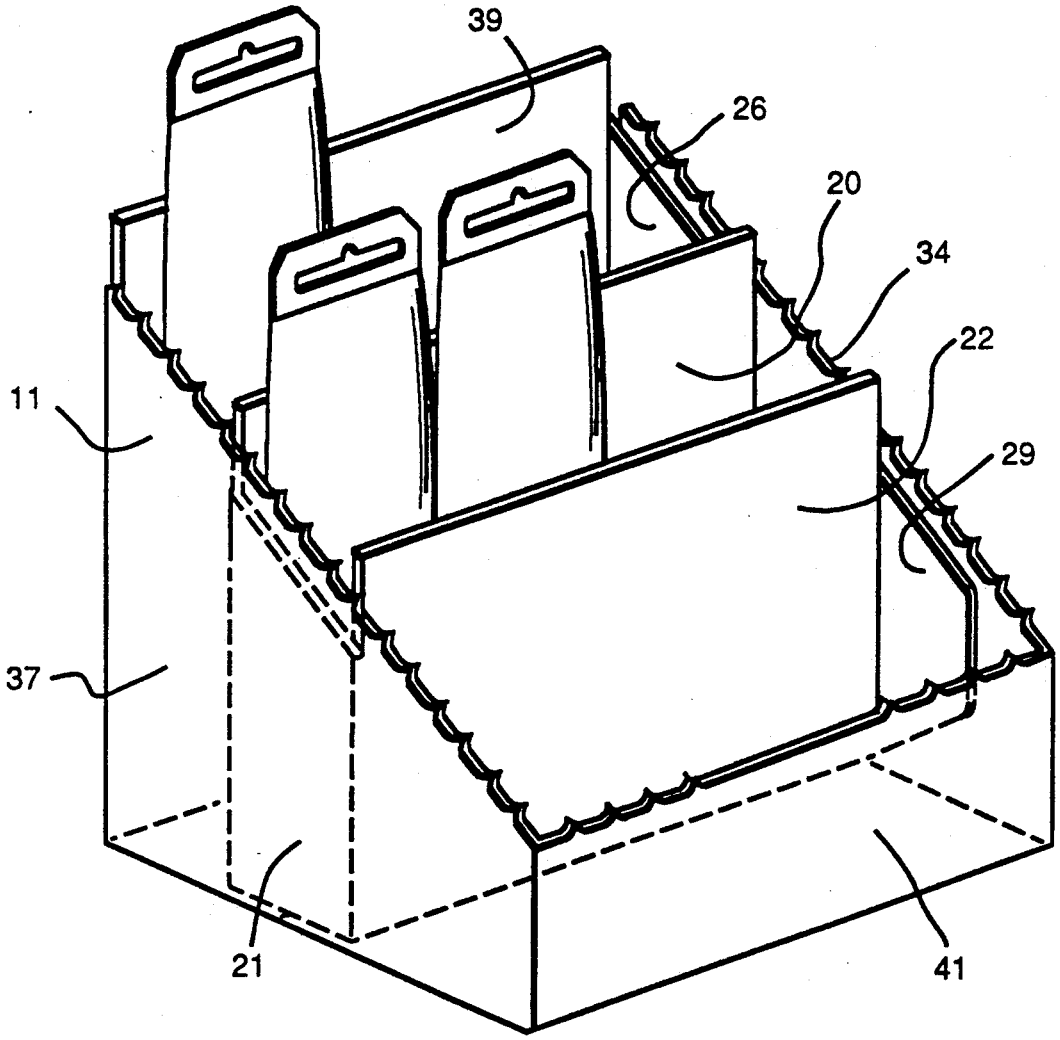
FIG. 3 is a perspective of a shipping carton of this invention converted into a display case providing a phantom view of dividers.

FIG. 3 illustrates the carton 10 after tear strip portions 12 and 13 have been removed and scores 19, 23 and 27 have been broken and upper portion 14 has been removed leaving lower portion 11 as an attractive display case. Front panel 41, rear panel 39, divider portions 20 and 22, and side panel portions 34 and 37 of lower portion 11 coact to maintain the contents of the display case in a substantially vertical position and neatly arranged. Front panel 41 of lower portion 11 is usually the lowest in height with each divider being increasingly higher with rear panel 39 of lower portion 11 being the greatest in height to facilitate attractive display of all the carton contents but without interfering with the removal of the upper portion 14 from lower portion 11 without the use of tools.

Figure 4:
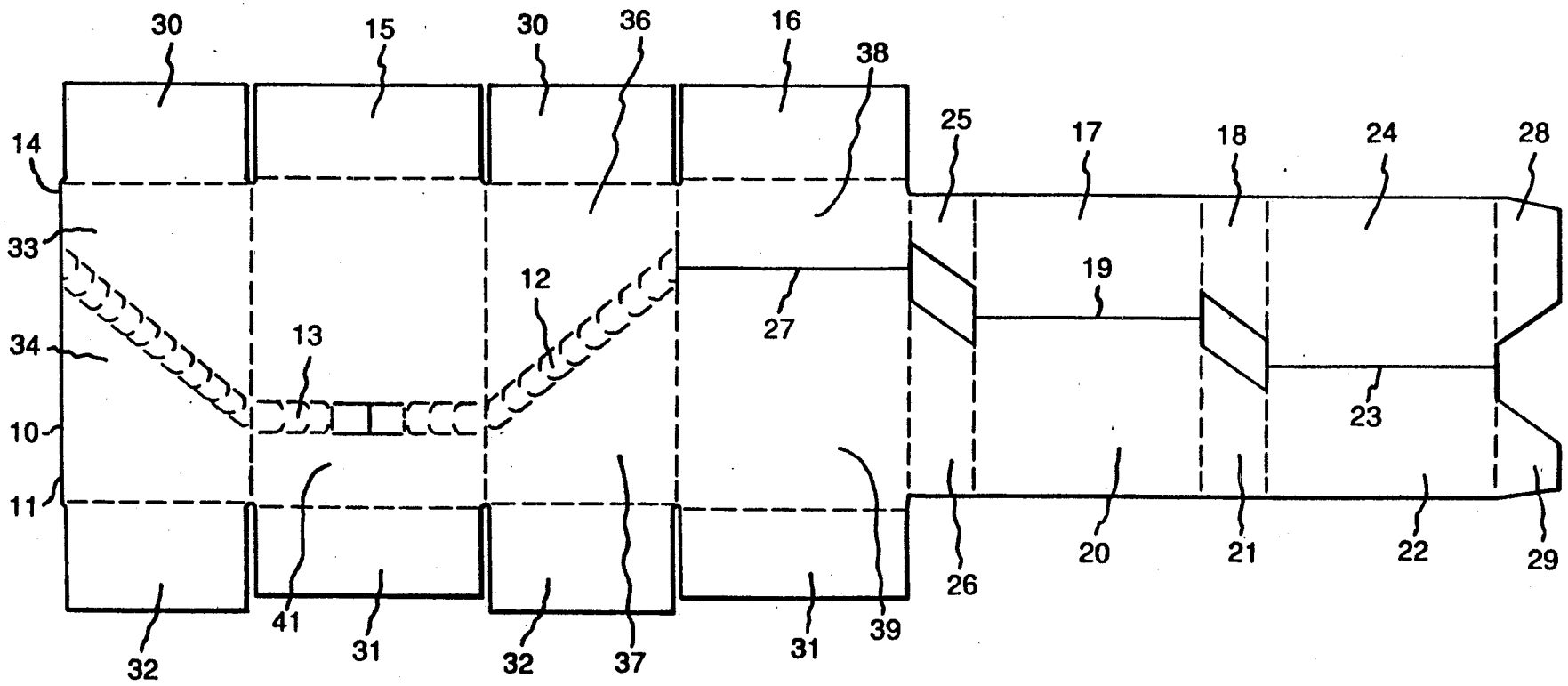
FIG. 4 is a plan view of the interior surface of a carton blank embodying this invention.

FIG. 4 shows the interior surface of the carton blank. The exterior surface not shown may also be plain but usually is printed with product identification, instructions for use and other informative and decorative items. The blank is folded and the tabs affixed to the side panels by suitable means such as with glue, adhesive, cement, staples, fasteners, tape and the like to provide a stable, strong carton, for shipping and upon removal of the upper portion 14, an attractive and useful display case. Not shown in, or described with respect to the other figures are the lower portion side flaps 32, lower portion front and rear flaps 31 and upper portion side flaps 30. Folding inwardly first the side flaps, then folding in the front and rear flaps and then affixing the front and rear flaps by suitable means such as glue, adhesive, cement, staples, fasteners, tape and the like reinforces the bottom and top of the carton and does not interfere with the removal of the upper portion from the lower portion without the need for tools. The coaction of the flaps and dividers give a strong damage resistant shipping carton which can be converted with surprising facility into an attractive and stable display case without the use of any tools by merely removing the tear strip and then breaking the scores with a simple twisting of the upper portion 14 while holding the lower portion 11 stationary. This combination of strength, easy conversion and attractiveness of display is not provided by any devices of the prior art.

Although the most common material employed in the carton of this invention is a corrugated paper laminate, any material lending itself to cutting out, folding, scoring and providing a surface for legible printing may be used. The tear strip may be of any convenient width and may have a series of scores of suitable length or perforations to define the boundary between the tear strip and the upper and lower portions of the carton of such frequency and size to facilitate easy separation from the upper and lower portion leaving a clean edge on the lower portion which converts to an attractive product display case.

I claim:

1. A multi-sided carton convertible to a display case without tools which is assembled from a single blank and which comprises an upper portion, a tear strip, a lower portion and a divider, said upper portion being separated from the lower portion by the tear strip in all but one side and in that remaining side by a score extending across the side and meeting the tear strip in the adjacent sides, said divider being situated in the assembled carton parallel to the side having a score, having an upper portion and a lower portion, said portions separated by the score, and tabs at each end, one of said tabs at one end of the divider being located in the upper portion of the carton and connecting the upper portion of the divider to the upper portion of the side with the score and one of said tabs at the same end being located in the lower portion of the carton and connecting the lower portion of the divider to the lower portion of the side with the score, said tabs at said end being capable of being affixed as a part of the assembly of the carton, to the upper and lower portions, respectively, of a side adjacent to the side with a score and being separated from each other so that there is no contact by the divider and the tabs of the divider with the tear strip and one of said tabs at the other end of the divider being located in the upper portion of the carton and, as a part of the assembly of the carton, being capable of being affixed to the upper portion of a side adjacent to the side with the score and one of said tabs at said other end of the divider being located in the lower portion of the carton and being capable of being affixed, as a part of the assembly of the carton, to the lower portion of said adjacent side and said tabs being separated from each other so that there is no contact by the divider with the tear strip, said lower portion of said divider being lower in height than the lower portion of the side with the score, said tear strip being completely removeable from the carton without the use of tools and said scores in the side and divider, before removal of the tear strip, being capable of holding the upper and lower portions of the carton together to provide a strong shipping carton but, after removal of the tear strip, being readily broken without the use of tools so that the upper portion of the carton is removed from the lower portion of the carton and the lower portion of the carton is converted to a display case which holds the contents in substantially vertical alignment.

2. The carton of claim 1 which, when assembled, is in the form of a rectangular solid.

3. The carton of claim 2 in which the side opposite the side with the score is lower in height than the divider.

4. The carton of claim 3 in which the tear strip is in two parts and the two parts meet in substantially the center of the side opposite the side with the score.

5. The carton of claim 4 in which there are two dividers and the dividers have tabs in the upper and and lower portions connecting the dividers, said connecting tabs being capable of being affixed to the side of the carton and being separated so that when the connecting tabs are so affixed there is no contact by the divider and the connecting tabs of the divider with the tear strip.

6. The carton of claim 5 in which the height of the rectangular solid is greater than either dimension of the base.

* * * * *